US006771258B2

(12) United States Patent
Aoki

(10) Patent No.: US 6,771,258 B2
(45) Date of Patent: Aug. 3, 2004

(54) SEMICONDUCTOR DEVICE

(75) Inventor: Shigeki Aoki, Suwa (JP)

(73) Assignee: Seiko Epson Corporation (JP)

( * ) Notice: Subject to any disclaimer, the term of this patent is extended or adjusted under 35 U.S.C. 154(b) by 241 days.

(21) Appl. No.: 09/997,226

(22) Filed: Nov. 29, 2001

(65) Prior Publication Data

US 2002/0080104 A1 Jun. 27, 2002

(30) Foreign Application Priority Data

Dec. 11, 2000 (JP) ..... 2000-376296

(51) Int. Cl.[7] ..... G09G 3/36
(52) U.S. Cl. ..... 345/204; 345/103
(58) Field of Search ..... 345/204, 87, 103, 345/211, 212; 257/238; 438/200

(56) References Cited

U.S. PATENT DOCUMENTS 6,525,718 B1 * 2/2003 Murakami et al. ..... 345/206
6,707,440 B2 * 3/2004 Aoki ..... 345/87

FOREIGN PATENT DOCUMENTS

JP 2000-39869 * 7/1998

* cited by examiner

*Primary Examiner*—Vijay Shankar
*Assistant Examiner*—Nitin Patel
(74) *Attorney, Agent, or Firm*—Harness, Dickey & Pierce, P.L.C.

(57) ABSTRACT

A semiconductor device is equipped with a silicon substrate 3, a segment signal output section 4 formed along a central portion of one edge in a longitudinal direction of the silicon substrate 3, common signal output sections 5–6 formed along portions on both sides of the central portion, divided power supply sections 7–8 formed opposite to the common signal output sections 5–6 along the other edge in the longitudinal direction of the silicon substrate 3, RAMs 9–10 formed between the power supply sections 7–8, and a control section 11.

10 Claims, 4 Drawing Sheets

SEMICONDUCTOR DEVICE

BACKGROUND OF THE INVENTION

1. Technical Field of the Invention

The present invention relates to a semiconductor device (a driver IC) that drives a display device such as a LCD panel or the like.

2. Conventional Art

A conventional driver IC that drives a LCD panel is described with reference to FIGS. 3–4.

FIG. 3 shows a LCD module using a conventional semiconductor device. As shown in FIG. 3, a LCD module 40 includes a driver IC 31, a LCD panel 20 and a glass substrate 41. In other words, the driver IC 31 and the LCD panel 20 are mounted on the glass substrate 41 to form the LCD module 40.

The LCD panel 20 has a plurality of regions 101, 102, . . . in a segment direction, and a plurality of regions 301, 302, . . . in a common direction. Here, by specifying one region in the segment direction and one region in the common direction, one pixel (dot) is specified. As an example, the LCD panel 20 has 160 regions along the segment direction, and also 160 regions along the common direction. In this case, the LCD panel 20 has 160×160 pixels.

The driver IC 31 has an elongated shape in one direction, and segment signal output terminals S201–S360 of gold (Au) bumps for outputting segment signals are formed along a central section of one edge (an upper edge in the figure) in the longitudinal direction of a mounting surface thereof. Also, common signal output terminals C201–C280 and C281–C360 of gold (Au) bumps for outputting common signals are formed along sections on both sides of the central section of the one edge (the upper edge in the figure) in the longitudinal direction of the mounting surface of the driver IC 31. Furthermore, input terminals Q1–Qn of gold (Au) bumps are formed along the other edge (a lower edge in the figure) of the longitudinal direction of the mounting surface of the driver IC 31.

Transparent wirings LS201–LS360 and LC201–LC360 are formed on the glass substrate 41. The regions 101–260 of the LCD panel 20 are connected to the segment signal output terminals S201–S360 of the driver IC 31 by the wirings LS201–LS360, respectively. Also, the regions 301–380 of the LCD panel 20 are connected to the common signal output terminals C201–C280 of the driver IC 31 by the wirings LC201–LC280, respectively, and the regions 381–460 of the LCD panel 20 are connected to the common signal output terminals C360–C281 of the driver IC 31 by the wirings LC360–LC281, respectively.

FIG. 4 shows an internal structure of the driver IC 31. In FIG. 4, the driver IC 31 includes a package 32 and a silicon substrate 33 that is sealed in the package 32.

A segment signal output section 34 is formed along one edge (an upper edge in the figure) in a longitudinal direction of the silicon substrate 33. Also, common signal output sections 35–36 are formed along both of the edges in a shorter edge direction of the silicon substrate 33. Furthermore, a power supply section 37, a control section 38, and a RAM 39 are formed along the other edge (a lower edge in the figure) in the longitudinal direction of the silicon substrate 33. The segment signal output section 34, the common signal output sections 35–36, the power supply section 37, the control section 38 and the RAM 39 are mutually connected by wirings (not shown).

The segment signal output section 34 is connected to the segment signal output terminals S201–S360, and outputs segment signals through the segment signal output terminals.

The common signal output section 35 is connected to the common signal output terminals C201–C280, and outputs common signals through these common signal output terminals. The common signal output section 36 is connected to the common signal output terminals C281–C360, and outputs common signals through these common signal output terminals C281–C360.

The power supply section 37, the control section 38 and the RAM 39 are connected to the input terminals Q1–Qn, and input a power supply potential, a control signal, image data and the like through these input terminals.

The power supply section 37 receives a power supply potential from the input terminal and performs a regulation thereof, and supplies a power to the common signal output sections 35–36, the control section 38 and the RAM 39.

The control section 38 is a logical circuit, which receives a control signal through the input terminal, and controls the segment signal output section 34, the common signal output sections 35–36, the power supply section 37 and the RAM.

The RAM 39 receives image data through the input terminal and stores the same.

Referring back to FIG. 3, segment signals are successively output from the segment signal output terminals S201–S360 of the LCD driver 31 by the segment signal output section 34 described above. On the other hand, common signals are successively output from the common signal output terminals C201–C280 and C360–C281 of the LCD driver 31 by the common signal output sections 35–36 described above. Accordingly, the LCD panel 20 can be driven by the LCD driver 31.

In the conventional driver IC 31 described above, the common signal output sections 35–36 are formed along both of the edges in a short edge direction of the silicon substrate 33, as shown in FIG. 4, in order to optimize the area efficiency.

However, when the common signal output sections 35–36 are formed along both of the edges in a short edge direction of the silicon substrate 33, the length of the silicon substrate 33 in the short-edge direction cannot be shortened, and therefore the length of the driver IC 31 in its short-edge direction cannot be shortened. This causes a problem in that it is difficult to narrow a frame section of the LCD module 40 to slim down the same. This problem is particularly noticeable in the case of a driver IC with numerous outputs.

Therefore, in view of the problems described above, it is an object of the present invention to provide a semiconductor device that can shorten the length of a driver IC in its short-edge direction, and narrow a frame section of a LCD module to slim down the same.

SUMMARY OF THE INVENTION

To solve the problems described above, a semiconductor device in accordance with the present invention pertains to a semiconductor device for supplying a first group of drive signals to a first group of signal electrodes and a second group of drive signals to a second group of signal electrodes of an image display apparatus that displays a two-dimensional image, the semiconductor device comprising: a semiconductor substrate; a first output section that is formed in a first region along a first edge in a longitudinal direction of the semiconductor substrate, and that outputs a specified number of drive signals among the first group of drive signals; a second output section that is formed in a second region along the first edge adjacent to the first region, and that outputs a second group of drive signals; a third output section that is formed in a third region along the first edge adjacent to the second region, and that output the remaining drive signals among the first group of drive signals; a first power supply section that is formed in a fourth region along a second edge in the longitudinal direction of the semiconductor substrate, and that supplies a power to at least the first output section; and a second power supply section that is formed in a fifth region along the second edge, and that supplies a power to at least the third output section.

The embodiment may further be provided with a storage section that is formed in a sixth region between the fourth region and the fifth region along the second edge and that successively stores input image data and supplies the same to the first through third output sections. Also, it may further be provided with a wiring that is formed above the first through third output sections through a dielectric layer for exchanging a potential between the first power supply section and the second power supply section. Furthermore, the image display apparatus may be a liquid crystal display apparatus, the first group of drive signals may be a plurality of common signals that are respectively supplied to a plurality of common electrodes of the liquid crystal display apparatus, and the second group of drive signals may be a plurality of segment signals that are respectively supplied to a plurality of segment electrodes of the liquid crystal display apparatus.

By the invention constructed in a manner described above, the length of a semiconductor device that drives an image display apparatus can be shortened in a short-edge direction of a semiconductor device, and a frame section of an image display module can be narrowed and a slimming-down thereof can be achieved.

DETAILED DESCRIPTION OF THE PREFERRED EMBODIMENT OF THE PRESENT INVENTION

An embodiment of the present invention is described below with reference to the accompanying drawings. It is noted that the same components are referred to by the same reference numbers, and their description is omitted.

Figure 1:
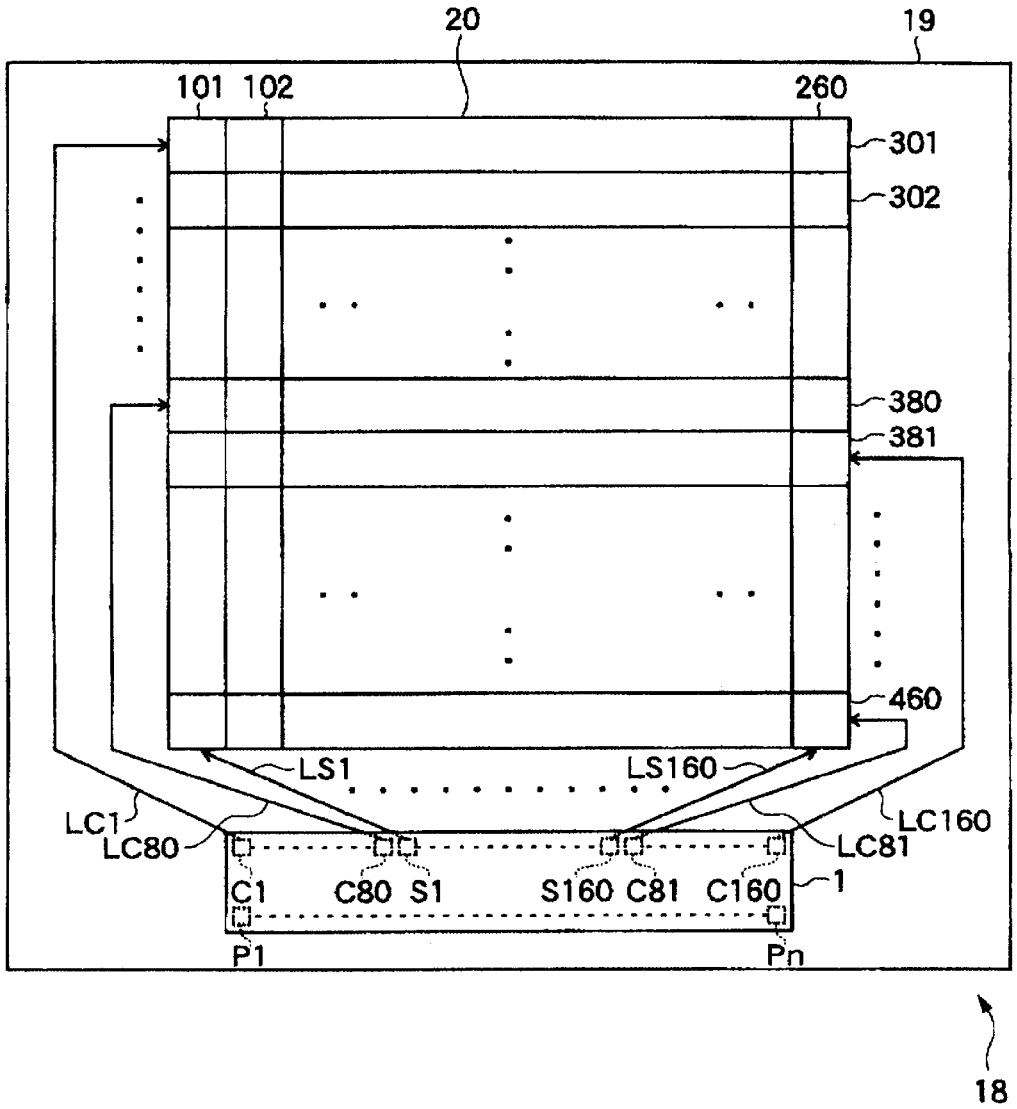
FIG. 1 shows an example of a LCD module using a semiconductor device in accordance with one embodiment of the present invention.

FIG. 1 shows a LCD module using a semiconductor device in accordance with one embodiment of the present invention. In the present embodiment, the present invention is applied to a LCD driver IC.

As shown in FIG. 1, a LCD module 18 includes a driver IC 1, a LCD panel 20 and a glass substrate 19. In other words, the driver IC 1 and the LCD panel 20 are mounted on the glass substrate 19 to form the LCD module 18.

The LCD panel 20 has a plurality of regions 101, 102, . . . in a segment direction, and a plurality of regions 301, 302, . . . in a common direction. Here, by specifying one region in the segment direction and one region in the common direction, one pixel (dot) is specified. As an example, the LCD panel 20 has 160 regions along the segment direction, and also 160 regions along the common direction. In this case, the LCD panel 20 has 160×160 pixels.

The driver IC 1 has an elongated shape in one direction, and segment signal output terminals S1–S160 of gold (Au) bumps for outputting segment signals are formed along a central section of one edge (an upper edge in the figure) in the longitudinal direction of a mounting surface thereof. Also, common signal output terminals C1–C80 and C81–C160 of gold (Au) bumps for outputting common signals are formed along sections on both sides of the central section of the one edge (the upper edge in the figure) in the longitudinal direction of the mounting surface of the driver IC 1. Furthermore, input terminals P1–Pn of gold (Au) bumps are formed along the other edge (a lower edge in the figure) of the longitudinal direction of the mounting surface of the driver IC 1.

Transparent wirings LS1–LS160 and LC1–LC160 are formed on the glass substrate 19. The regions 101–260 of the LCD panel 20 are connected to the segment signal output terminals S1–S160 of the driver IC 1 by the wirings LS1–LS160, respectively. Also, the regions 301–380 of the LCD panel 20 are connected to the common signal output terminals C1–C80 of the driver IC 1 by the wirings LC1–LC80, respectively, and the regions 381–460 of the LCD panel 20 are connected to the common signal output terminals C160–C81 of the driver IC 1 by the wirings LC160–LC81, respectively.

Figure 2:
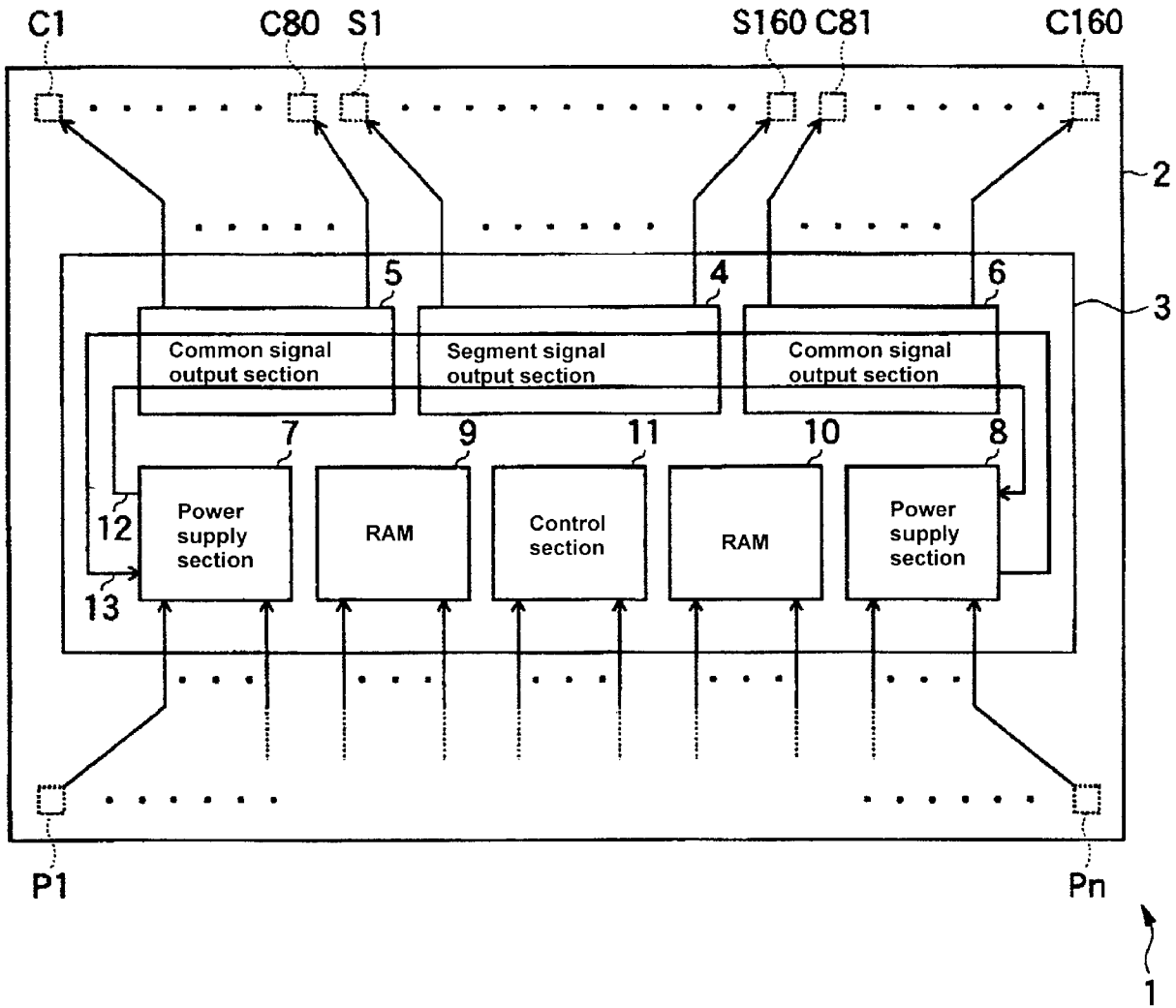
FIG. 2 shows a structure of a semiconductor device in accordance with one embodiment of the present invention.
Figure 3:
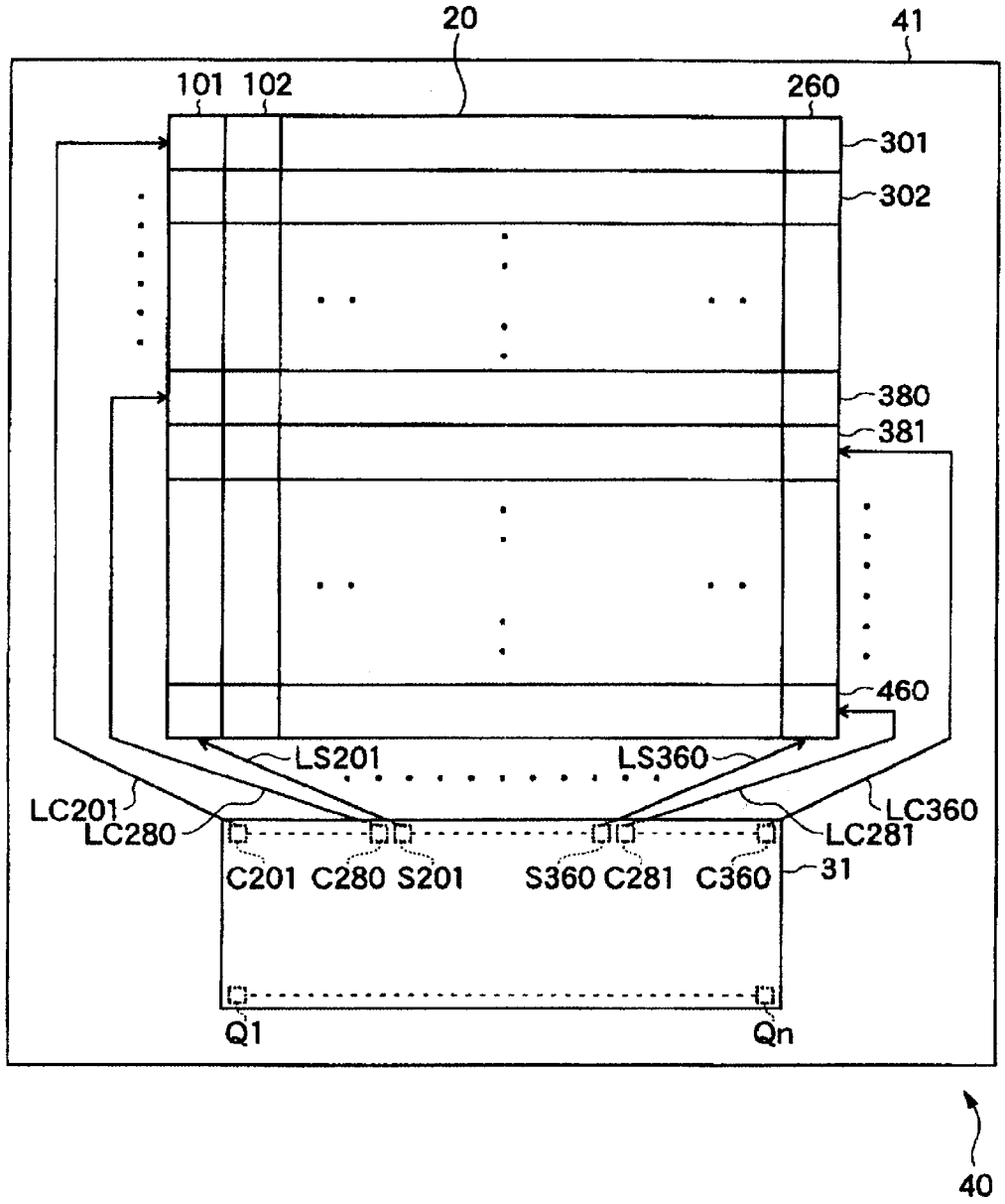
Fig. 3 PRIOR ART
FIG. 3 shows a LCD module using a conventional driver IC.
Figure 4:
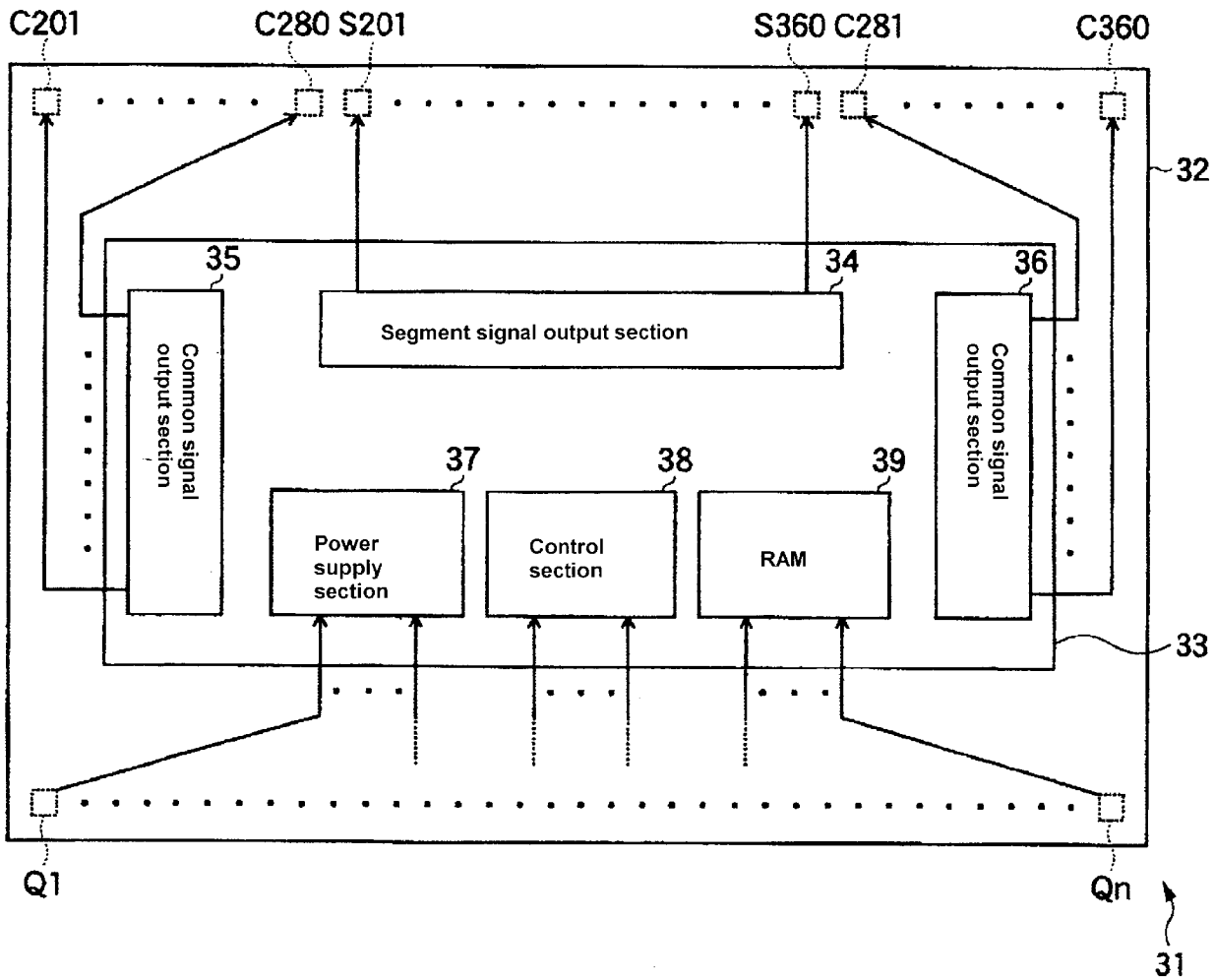
Fig. 4 PRIOR ART
FIG. 4 shows a structure of a conventional driver IC.

FIG. 2 shows an internal structure of the driver IC 1. In FIG. 2, the driver IC 1 includes a package 2 and a silicon substrate 3 that is sealed in the package 2.

A segment signal output section 4 is formed along a central section of one edge (an upper edge in the figure) in a longitudinal direction of the silicon substrate 3. Also, common signal output sections 5–6 are formed along both sides of the central section of the one edge (the upper edge in the figure) in the longitudinal direction of the silicon substrate 3.

Furthermore, divided power supply sections 7–8 are formed opposite to the common signal output sections 5–6 (below the common signal output sections 5–6 in the figure) along the other edge (a lower edge in the figure) in the longitudinal direction of the silicon substrate 3. Also, RAMs 9–10 and a control section 11 are formed between the power supply sections 7–8 along the other edge (the lower edge in the figure) in the longitudinal direction of the silicon substrate 3.

The power supply section 7 and the power supply section 8 are connected to one another by power supply wirings 12–13 that are formed in a manner to pass over the segment signal output section 4 and the common signal output sections 5–6. Also, the segment signal output section 4, the common signal output sections 5–6, the power supply sections 7–8, the RAMs 9–10, and the control section 11 are mutually connected by wirings (not shown).

The segment signal output section 4 is connected to the segment signal output terminals S1–S160, and outputs segment signals through these segment signal output terminals. The common signal output section 5 is connected to the common signal output terminals C1–C80, and outputs common signals through these common signal output terminals. The common signal output section 6 is connected to the common signal output terminals C81–C160, and outputs common signals through these common signal output terminals.

The power supply sections 7–8, the RAMs 9–10 and the control section 11 are connected to the input terminals P1–Pn, and input a power supply potential, a control signal, image data and the like through these input terminals P1–Pn.

The power supply sections 7–8 receives a power supply potential from the input terminal and performs a regulation thereof, and supplies a power to segment signal output section 4, the common signal output sections 5–6, RAMs 9–10, and the control section 11. Also, the power supply sections 7–8 mutually supply an intermediate potential in the regulation by the power supply wirings 12–13.

The RAMs 9–10 receive image data from the input terminal and store the same.

The control section 11 is a logical circuit, which receives a control signal through the input terminal, and controls the segment signal output section 4, the common signal output sections 5–6, the power supply sections 7–8, and the RAMs 9–10.

Referring back to FIG. 1, segment signals are successively output from the segment signal output terminals S1–S160 of the LCD driver. On the other hand, common signals are successively output from the common signal output terminals C1–C80 and C160–C81 of the LCD driver 1 by the common signal output sections 5–6. Accordingly, the LCD panel 20 can be driven by the LCD driver 1.

In accordance with the present embodiment, the common signal output sections 5–6 in the LCD driver 1 are formed along an edge in a longitudinal direction of the silicon substrate 3, not along an edge in a shorter edge direction thereof. As a result, the length of the silicon substrate 3 in its shorter edge direction can be shortened, and the length of the driver IC 1 in its shorter edge direction can be shortened. Accordingly, the LCD module 18 can have a narrowed frame section and it can be slimmed down. Also, the power supply wirings 12–13 are formed in a manner to pass over the segment signal output section 4 and the common signal output sections 5–6, and intermediate potentials are supplied through the power supply wirings 12–13 to the segment signal output section 4, the common signal output sections 5–6, the RAMs 9–10 and the control section 11. As a consequence, a power supply on the silicon substrate 3 is divided into two power supply sections 7–8, with the result that the area of the silicon substrate 3 does not increase because of the required wirings.

As described above, in accordance with the present invention, a segment signal output section is formed along a central portion of one edge in a longitudinal direction of a silicon substrate, first and second common signal output sections are formed along portions on both sides of the central portion of the one edge in the longitudinal direction of a silicon substrate, and first and second power supply sections are formed opposite to the first and second common signal output sections along the other edge in the longitudinal direction of the silicon substrate. As a result, the length of a driver IC in its shorter edge direction can be shortened. Accordingly, a LCD module can have a narrowed frame section and therefore it can be slimmed down.

The entire disclosure of Japanese Patent Application No. 2000-376296(P) filed Dec. 11, 2000 is incorporated by reference herein.

What is claimed is:

1. A semiconductor device for supplying a first group of drive signals to a first group of signal electrodes and a second group of drive signals to a second group of signal electrodes of an image display apparatus that displays a two-dimensional image, the semiconductor device comprising:

a semiconductor substrate;

a first output section that is formed in a first region along a first edge in a longitudinal direction of the semiconductor substrate, the first output section being adapted to output a specified number of drive signals among the first group of drive signals;

a second output section that is formed in a second region along the first edge adjacent to the first region, the second output section being adapted to output a second group of drive signals;

a third output section that is formed in a third region along the first edge adjacent to the second region, the third output section being adapted to output the remaining drive signals among the first group of drive signals;

a first power supply section that is formed in a fourth region along a second edge in the longitudinal direction of the semiconductor substrate, the first power supply being adapted to supply power to at least the first output section; and a second power supply section that is formed in a fifth region along the second edge, the second power supply being adapted to supply power to at least the third output section.

2. A semiconductor device according to claim 1, further comprising a storage section that is formed in a sixth region between the fourth region and the fifth region along the second edge, the storage section being adapted to store successively input image data and supply the same to the first, second, and third output sections.

3. A semiconductor device according to claim 1, further comprising a wiring that is formed above the first, second, and third output sections through a dielectric layer for exchanging a potential between the first power supply section and the second power supply section.

4. A semiconductor device according to claim 1, wherein the image display apparatus is a liquid crystal display apparatus, the first group of drive signals are a plurality of common signals that are respectively supplied to a plurality of common electrodes of the liquid crystal display apparatus, and the second group of drive signals are a plurality of segment signals that are respectively supplied to a plurality of segment electrodes of the liquid crystal display apparatus.

5. A semiconductor device comprising:

a rectangular substrate having a first major edge, a second major edge and two minor edges extending therebetween;

a first output section disposed adjacent said first major edge and proximate one of said two minor edges;

a second output section disposed adjacent said first major edge and proximate the other of said two minor edges;

a third output section disposed adjacent said first major edge and between said first and second output sections;

a first power supply disposed adjacent said second major edge and proximate said one of said two minor edges; and a second power supply disposed adjacent said second major edge and proximate said other of said two minor edges.

6. The semiconductor device of claim 5 further comprising:

a storage section disposed adjacent said second major edge and between said first and second power supplies.

7. The semiconductor device of claim 5 further comprising:

wiring coupled to said first and second power supplies and extending over said first, second, and third output sections in a dielectric layer.

8. The semiconductor device of claim 7 wherein said wiring extends along said one minor edge between said first power supply and an area over said first output section, and along said other minor edge between an area over said second output section and said second power supply.

9. The semiconductor device of claim 5 further comprising a first RAM unit disposed adjacent said second major edge and proximate said first power supply, and a second RAM unit disposed adjacent said second major edge and proximate said second power supply.

10. The semiconductor device of claim 9 further comprising a control section disposed adjacent said second major edge and between said first and second RAM units.

* * * * *